US006883623B2

(12) United States Patent
McCormick et al.

(10) Patent No.: US 6,883,623 B2
(45) Date of Patent: Apr. 26, 2005

(54) EARTH BORING APPARATUS AND METHOD OFFERING IMPROVED GAGE TRIMMER PROTECTION

(75) Inventors: Ronny D. McCormick, Magnolia, TX (US); Mumtaz Ball, Maracaibo (VE); Mark E. Anderson, Portland, TX (US); Mark W. Dykstra, Kingwood, TX (US); Michael L. Doster, Spring, TX (US); Matthew R. Isbell, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/268,595

(22) Filed: Oct. 9, 2002

(65) Prior Publication Data

US 2004/0069531 A1 Apr. 15, 2004

(51) Int. Cl.[7] ..... E21B 17/10

(52) U.S. Cl. ..... 175/408; 175/57; 175/415; 175/426

(58) Field of Search ..... 175/57, 331, 378, 175/426, 415, 417, 393, 408, 431

(56) References Cited

U.S. PATENT DOCUMENTS

| | | | | |
|---|---|---|---|---|
| 3,724,564 A | * | 4/1973 | Messenger | 175/72 |
| 4,940,099 A | * | 7/1990 | Deane et al. | 175/374 |
| 4,991,670 A | | 2/1991 | Fuller et al. | |
| 5,467,836 A | | 11/1995 | Grimes et al. | |
| 5,979,576 A | | 11/1999 | Hansen et al. | |
| 6,102,140 A | * | 8/2000 | Boyce et al. | 175/374 |
| 6,337,308 B1 | * | 1/2002 | Adams et al. | 507/117 |
| 6,349,780 B1 | | 2/2002 | Beuershausen | |
| 6,397,958 B1 | | 6/2002 | Charles et al. | |

FOREIGN PATENT DOCUMENTS

| | | |
|---|---|---|
| GB | 2355035 A | 4/2001 |
| GB | 2 365 893 A | 2/2002 |
| GB | 2 369 140 A | 5/2002 |

OTHER PUBLICATIONS

UK Search Report dated Nov. 20, 2003 (3 pages).
http://www.bakerhughes.com/hcc/features/tricone.htm, Jun. 12, 2002, Advertisement: "Optional Features—Diamond Bits," Hughes Christensen, 4 pages.

* cited by examiner

*Primary Examiner*—David Bagnell
*Assistant Examiner*—Giovanna Collins
(74) *Attorney, Agent, or Firm*—TraskBritt

(57) ABSTRACT

A rotary drill bit for drilling subterranean formations configured with at least one protective structure proximate to the rotationally leading and trailing edges of a gage trimmer, wherein the at least one protective structure is positioned at substantially the same exposure as its associated gage trimmer. Particularly, the apparatus of the present invention may provide protection for gage trimmers during drilling, tripping, and/or rotation within a casing; i.e., when changing a drilling fluid. Protective structures may be configured and located according to anticipated drilling conditions including helix angles. In addition, a protective structure may be proximate to more than one gage trimmer while having a substantially equal exposure to each associated gage trimmer. Methods of use and a method of rotary bit design are also disclosed.

51 Claims, 10 Drawing Sheets

EARTH BORING APPARATUS AND METHOD OFFERING IMPROVED GAGE TRIMMER PROTECTION

BACKGROUND OF THE INVENTION

1. Field of the Invention

The present invention relates generally to drilling a subterranean borehole and, more specifically, to protecting gage trimmers located adjacent to the gage of a drill bit by way of protective structures. The method and apparatus of the present invention may effect such protection for gage trimmers during drilling and/or during rotation within a casing, i.e., when changing a drilling fluid.

2. State of the Art

Fixed cutter rotary drill bits for drilling oil, gas, and geothermal wells, and other similar uses typically comprise a solid metal or composite matrix metal body having a lower cutting face region and an upper shank region for connection to the bottom hole assembly of a drill string formed of conventional jointed tubular members, which are then rotated as a single unit by a rotary table, top drive, drilling rig, or downhole motor, alone or in combination with one another. Alternatively, rotary drill bits may be attached to a bottomhole assembly including a downhole motor assembly which is in turn connected to essentially continuous tubing, also referred to as coiled, or reeled, tubing wherein the downhole motor assembly rotates the drill bit. Typically, the bit body has one or more internal passages for introducing drilling fluid, or mud, to the cutting face of the drill bit to cool cutters provided on the face of the drill bit and to facilitate formation chip and formation fines removal. The sides of the drill bit typically include a plurality of radially extending blades that have an outermost surface of a substantially constant diameter and generally parallel to the central longitudinal axis of the drill bit, commonly known as gage pads. The gage pads generally contact the wall of the bore hole being drilled in order to support and provide guidance of the drill bit as it advances along a desired cutting path, or trajectory.

As known within the art, blades provided on a given drill bit may be selected to be provided with outwardly extending, replaceable cutting elements installed on the gage pad allowing the cutting elements to engage the formation being drilled and to assist in providing gage-cutting, or side-cutting, action therealong. Replaceable cutters may also be placed adjacent to the gage area of the drill bit. One type of cutting element provided on or adjacent to gage pads in the past, referred to as inserts, compacts, and cutters, has been known and used for a relatively long time on the lower cutting face for providing the primary cutting action of the bit. These cutting elements are typically manufactured by forming a superabrasive layer, or table, upon a sintered tungsten carbide substrate. As an example, a polycrystalline diamond table, or cutting face, is sintered onto the sintered tungsten carbide substrate under high pressure and temperature, typically about 1450° to about 1600° Celsius and about 50 to about 70 kilo bar pressure to form a polycrystalline diamond compact (PDC) cutting element or PDC cutter. During this process, a metal sintering aid or catalyst such as cobalt may be premixed with the powdered diamond or swept from the substrate into the diamond to form a bonding matrix at the interface between the diamond and substrate.

The above-described PDC cutting elements, or cutters, when installed on or adjacent to gage pads instead of on the lower portion of the face of the drill bit, are generally referred to as "gage trimmers" as such a cutting element cuts the outermost gage dimension, or diameter, for the particular drill bit in which the cutters are installed. That is, the cutters, or more particularly the cutting surfaces thereof, being positioned at the furthermost radial distance from the longitudinal centerline of the drill bit, i.e., the outer periphery of the drill bit, will define the final diameter of the borehole being formed as a result of the drill bit engaging, cutting, and displacing the subterranean formation material in the forming of a well bore.

One particular situation that may damage gage trimmers is rotating the drill bit within a casing while a mud mixture or formulation is changed. For instance, mud formulation may be changed when moving from one type of subterranean formation to another in that oil-based mud formulations are typically preferred to water-based mud formulations when drilling shale. In the case of using downhole motors, the bit may necessarily rotate while the mud is changed because the flow of drilling fluid causes the downhole motor to rotate. Changing a drilling fluid (mud), as used herein, includes the addition of any additive or modifying a mud characteristic including: mud weight, pH, chemical composition, physical composition or viscosity.

Another condition where gage trimmers may be damaged may exist when a drill bit is "whirling." Bit whirl is a complicated motion that includes many types of bit movement patterns or modes of motion wherein the bit typically does not rotate about its intended axis of rotation and may not remain centered within the borehole. Bit whirl may typically occur at relatively low weight-on-bit (WOB) coupled with relatively high rotational speed while drilling a borehole. Under either aforesaid conditions the gage trimmers may contact the side of the borehole or casing and be damaged. Therefore, there exists a need to protect gage trimmers under such conditions.

Prior art uses of tungsten carbide protective structures include various configurations on fixed cutter reamers and tricone bits. On tricone bits, ovoid sintered carbide protective structures have been used on the heel row of the cones. On fixed cutter reamers, ovoid sintered carbide protective structures have been used as described in U.S. Pat. No. 6,397,958, assigned assignee of the present invention, as being placed on the radially outer surface of a blade and facing generally radially outwardly, for example, on a rotationally trailing blade and/or on a rational leading blade, thus being circumferentially offset from a given blade, to provide an additional pass-through point to accommodate erratic rotational motion of the tool in the casing during drill out. Ovoid sintered tungsten carbide compacts may also be used sacrificially when drilling out the casing by being overexposed while drilling the casing.

U.S. Pat. No. 6,349,780 to Beuershausen, assigned to the assignee of the present invention, discloses a drill bit configured with gage pads of differing aggressiveness. In addition, Beuershausen also discloses that a drill bit may include gage-cutting elements of more than two levels or degrees of aggressivity.

U.S. Pat. No. 5,979,576 to Hansen et al., assigned to the assignee of the present invention, discloses that flank cutters with a depth of cut that is less than the "active cutting area" may be employed to reduce wear in the bearing zone of an antiwhirl bit. The flank cutters do not normally contact the borehole, except under certain drilling conditions such as reaming or high rates of penetration wherein whirl tendencies are not as pronounced. Hansen also teaches that natural diamond or diamond-impregnated studs may be placed in front of or behind the flank cutters to control the cutting forces generated adjacent the bearing zone.

U.S. Pat. No. 4,991,670 to Fuller et al. describes a plurality of protuberances impregnated with super hard particles that are positioned in a trailing relationship to a plurality of cutters.

BRIEF SUMMARY OF THE INVENTION

The present invention comprises a drilling tool having at least one gage trimmer and at least one protective structure placed proximate to a leading edge and a trailing edge of the at least one gage trimmer. More specifically, at least one protective structure is placed proximate to the leading and trailing edges of at least one gage trimmer so as to protrude or extend from the gage profile to an extent substantially equal to the exposure of the at least one gage trimmer in order to protect the at least one gage trimmer. In such a configuration, a protective structure proximate to the leading and trailing edges of a gage trimmer will contact the formation generally when the gage trimmer comes into contact with the formation along the wall of the formation. Particularly, when the gage of the bit encounters impact with the borehole or casing, the protective structure(s) engage the formation material, thus preventing damage to the gage trimmer and extending bit life. In addition, a protective structure may be configured with a contact area for contacting a borehole or casing that may be larger than the surface of the gage trimmer that may contact a borehole or casing. Further, if the drill bit is rotated within a casing or borehole without drilling, the protective structure(s) substantially limit the ability of the gage trimmer to engage or become damaged by contact with the inner diameter of the casing or borehole.

Protective structures are less wear resistant than a superabrasive material layer of the gage trimmer. Thus, the protective structures do not greatly impede the cutting function of the gage trimmer during drilling, as the protective structures relatively quickly wear down, leaving the gage trimmers exposed for cutting. However, during unstable motion of the drill bit, i.e., whirling or when the drill bit is rotated inside the casing, the gage trimmers may experience impact loading. Protective structures according to the present invention may impede such impact loading from damaging the gage trimmers.

In general, to effect placement of protective structures proximate to the leading and trailing edges of a gage trimmer, gage trimmers will be located accordingly on a corresponding blade to allow for placement of protective structures. Several different gage trimmer and protective structure placement configurations are contemplated, one being separate protective structures that are located respectively proximate to the leading edge and trailing edge of a gage trimmer. Another configuration comprises a protective structure that is proximate to the leading edges of more than one gage trimmer, while a second protective structure is placed proximate to the trailing edges of more than one gage trimmer. Another configuration includes a protective structure designed and placed so that it is proximate to the leading edge of one or more gage trimmers, while also being proximate to the trailing edge of one or more other gage trimmers. Further, it is contemplated that one protective structure may be located proximate to both the leading and trailing edges of at least one gage trimmer; one configuration example being a doughnut-shaped structure that is placed surrounding or substantially surrounding a gage trimmer. A further example is a generally C-shaped structure proximate to the periphery of a gage trimmer.

Although the protective structures may have domed or ovoidal top surfaces, many alternative configurations are contemplated by the present invention. For instance, a protective structure may comprise generally or partially planar or flat, cylindrical, conical, spherical, rectangular, triangular, or arcuate shapes, and/or be otherwise geometrically configured and suitably located to provide protection to a gage trimmer. The protective structure of the present invention may comprise a sintered tungsten carbide compact, as known in the art. However, the present invention is not limited only to sintered tungsten carbide and may comprise other metals, sintered metals, alloys, or ceramics.

In addition, positioning of a gage trimmer and a protective structure proximate to the leading and trailing edges of the gage trimmer may be tailored to the operating conditions of the drill bit. For instance, the helical path of a gage trimmer depends on the ROP and the rotational speed of the drill bit. Therefore, it may be desired to tailor the position of the protective structure to a predicted helix angle associated with a given ROP and bit rotational speed, or relatively tight ranges of both or either. Alternatively, it may be desired to provide a protective structure arrangement that is tailored to a range of helix angles associated with widely varying ROPs and bit rotational speeds. Further, the same or additional protective structures may be aligned for separate or differing operating conditions, such as drilling, tripping, and/or rotation within a casing when changing a drilling fluid, drilling a casing shoe and/or float equipment (which includes float shoes and float collars), or other motion that may be encountered by the drill bit.

As noted hereinabove, protective structures of the present invention may be sized and positioned to have substantially the same exposure as their respective gage trimmers. This may be advantageous because the protective structure(s) thereby prevent impact loading because the protective structure(s) make contact with the borehole or other surface at substantially the same exposure as the gage trimmer. Upon wearing, the protective structure(s) may maintain substantially the same exposure as the gage trimmer, or may have only slightly less than the exposure of the gage trimmer. Stated another way, although the protective structure(s) have much less wear resistance than the superabrasive layer of the gage trimmer and therefore do not substantially impede the gage trimmer from engaging the formation, the protective structure wear may be determined, to a large extent, by the wear of the gage trimmer because if the protective structure is less exposed than the gage trimmer, the gage trimmer will prevent further wear of the protective structure as it will be cutting a diameter greater than the exposure of the protective structure. As the gage trimmer wears at a slow rate, the protective structure(s) may be exposed to the formation and may be worn to substantially the same or a slightly lesser exposure. Thus, upon installation and subsequent grinding (if required), the gage trimmer and its associated protective structure(s) may be substantially equally exposed and may remain substantially equally exposed or slightly less exposed during continued use. Additionally, gage trimmers and associated protective structure(s) may be replaced and ground (if necessary) to a common exposure.

Other features and advantages of the present invention will become apparent to those of ordinary skill in the art through consideration of the ensuing description, the accompanying drawings, and the appended claims.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
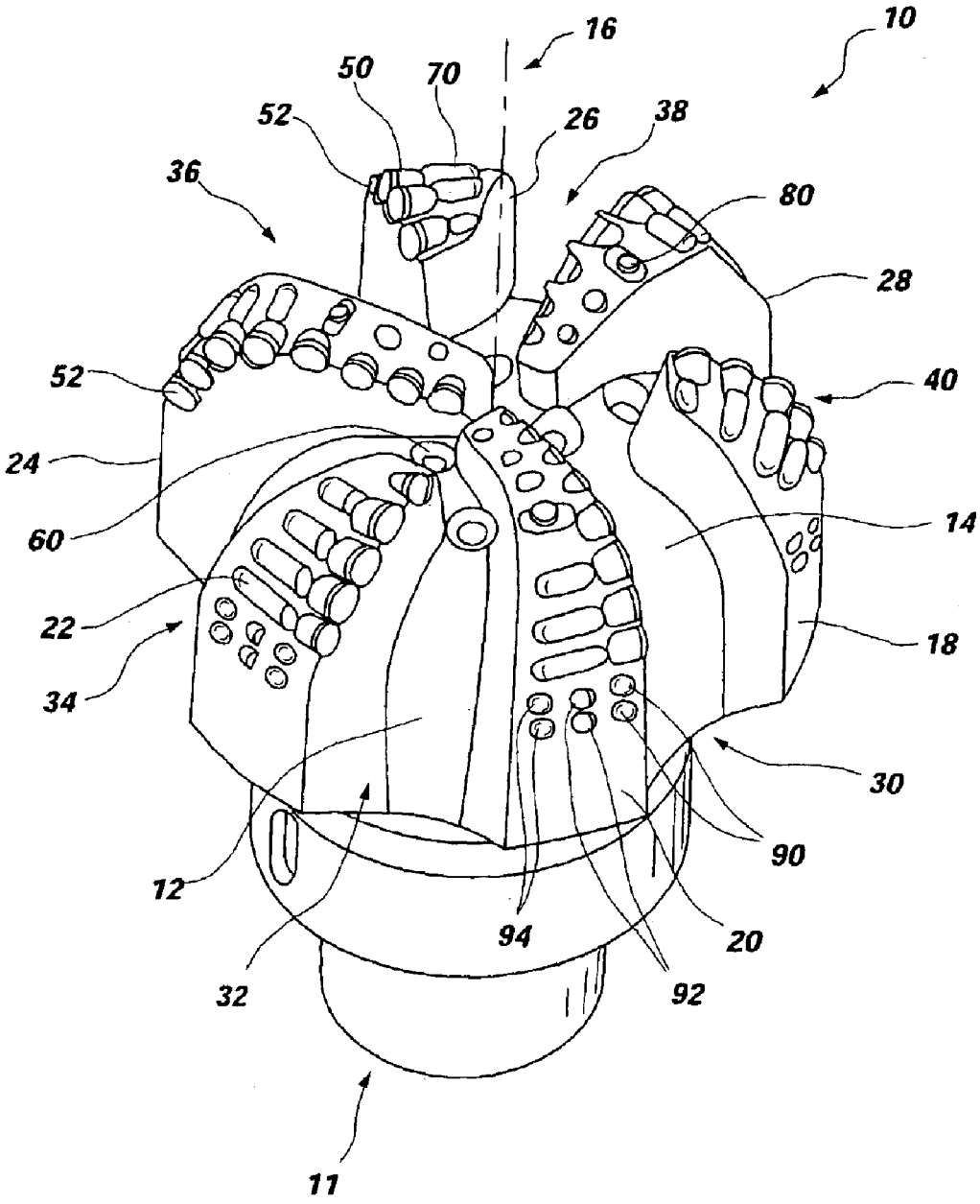
FIG. 1 is a perspective view of an exemplary drill bit having protective structures proximate to the leading and trailing edges of a gage trimmer.
Figure 2:
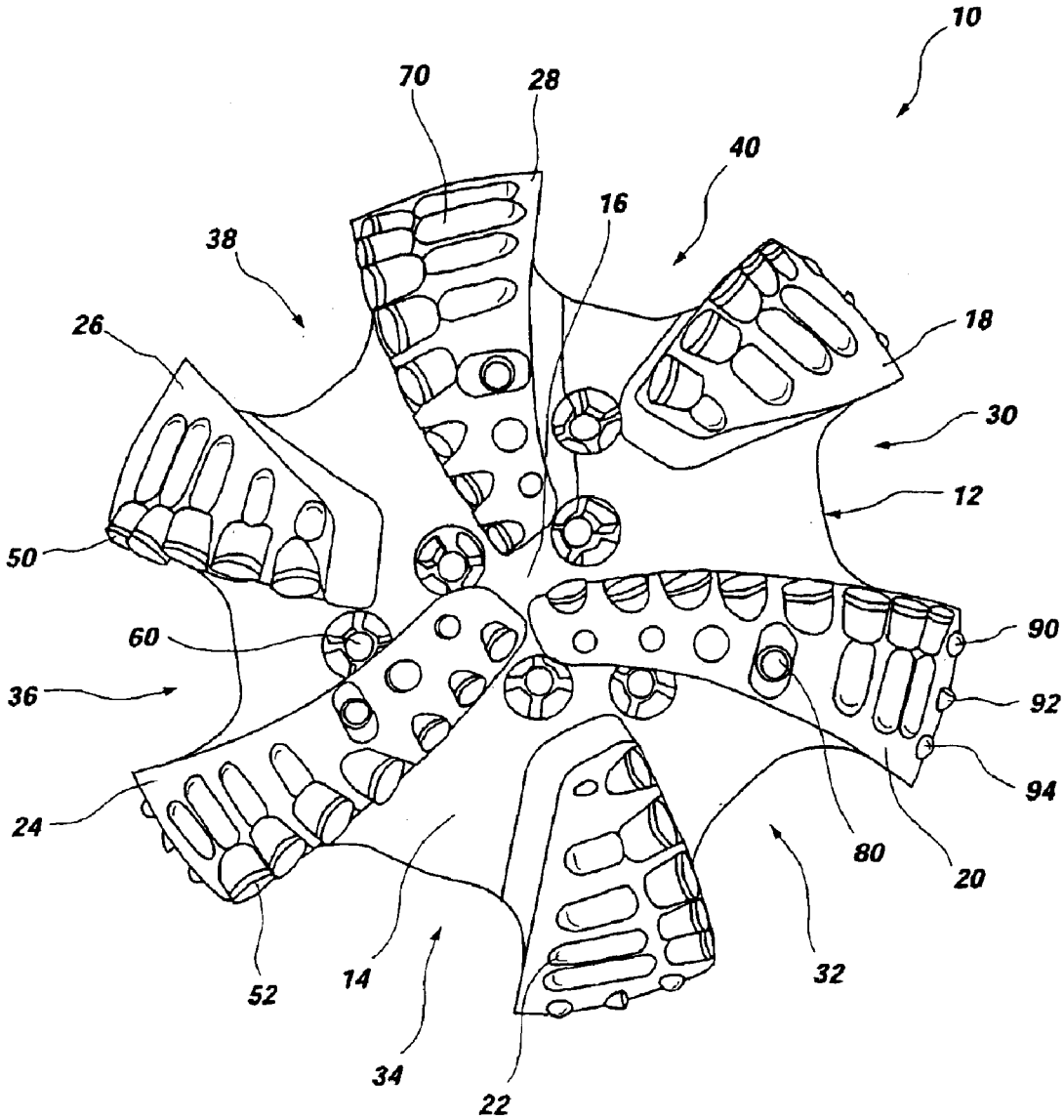
FIG. 2 is a bottom view of the face of an exemplary drill bit such as depicted in FIG. 1.

Referring to FIGS. 1 and 2 of the drawings, a rotary drag bit 10 of the present invention is illustrated. Rotary drag bit 10 includes a body 12 having a face 14 radially extending outward from the centerline or longitudinal axis 16 of the bit body 12. Six blades comprising primary blades 20, 24, and 28 as well as secondary blades 18, 22, and 26 respectively extend over and above face 14 and radially outwardly therebeyond, defining six longitudinally extending junk slots 30, 32, 34, 36, 38, and 40 therebetween. The terms "primary" and "secondary" are employed with regard to the relative volumes of rock cut by the cutter groups of the various blades. A plurality of superabrasive cutters 50, preferably PDCs, may be mounted to each blade 18 through 28 with their cutting faces 52 facing generally in the direction of bit rotation. Wear knots 70 follow many of the cutters shown, positioned distal to the cutting face 52 of each respective cutter 50. In addition, secondary cutters 80, comprising sintered carbide compacts having superabrasive tables oriented generally perpendicular to the faces of cutters 50, follow between cutters 50 along the inner radius of the primary blades 20, 24, and 28 and may provide more stability as well as limit the depth of cut, especially during directional drilling. The secondary cutters 80 may also be configured with relatively large chamfers on the edge of the diamond table and extending into the sintered carbide substrate as known in the art. Each group of cutters 50, respectively mounted to blades 18 through 28, generates cuttings of formation material in front of that cutter group as the rotary drag bit 10 is rotated by a drill string and weight is applied to the rotary drag bit 10 through the drill string. The drill string may be attached to the bit body 12 by way of threaded shank 11, as known in the art. Also, a plurality of nozzles 60 is shown on bit body face 14. During drilling, drilling fluid flow from the nozzles 60 carries formation cuttings generated by each group of cutters 50 into junk slots 30 through 40 and, ultimately, into the well bore annulus above rotary drag bit 10 between the drill string and the well bore sidewall.

Gage trimmers 92 are shown in FIGS. 1 and 2, on each blade 18 through 28 (on blades 18, 20, and 22 only in FIG. 1), and may be generally positioned radially outward from the cutters 50, adjacent the outer diameter of the rotary drill bit 10 during operation. Gage trimmers 92 as depicted comprise superabrasive cutters and a radially outermost, longitudinally extending cutting edge thereof, may be ground to conform to the design diameter or "gage" to be drilled by the rotary drill bit 10. In addition, leading and trailing protective structures 90 and 94 may also be ground to substantially the same exposure as associated gage trimmers 92. As depicted in FIGS. 1 and 2, gage trimmers 92 on blade 20 may be configured generally centrally on blade 20 with respect to the circumferential extent thereof, with leading protective structures 90 proximate to the leading edges of gage trimmers 92 and trailing protective structures 94 proximate the trailing edges of gage trimmers 92. Leading protective structures 90 and trailing protective structures 94 may be configured to have substantially the same exposure as their associated gage trimmer 92 or associated gage trimmers 92. Therefore, as different gage trimmers may exhibit differing exposures, their associated leading and trailing protective structures may be tailored to attain substantially equal exposure to the associated gage trimmer exposure.

Protective structures such as 90 and 94 may comprise sintered tungsten carbide inserts as known in the art. Protective structures may be brazed or infiltrated into a so-called matrix bit, the bit being comprised of particulate tungsten carbide and a metal infiltrant, such as a copper-based alloy. In the case of a steel body drill bit, protective structures may be affixed to the bit body by pressing the protective structures into appropriately dimensioned apertures, or brazed therein. The present invention is not limited to any one attachment technique. Tungsten carbide inserts serving as protective structures provide increased protection for gage trimmers from impact loading, but wear at a much higher rate than the superabrasive table of the gage trimmer. Therefore, during drilling operations, the protective structures generally do not prevent the gage trimmer from engaging the formation, due to the former's relatively higher wear rate.

Figure 3A:
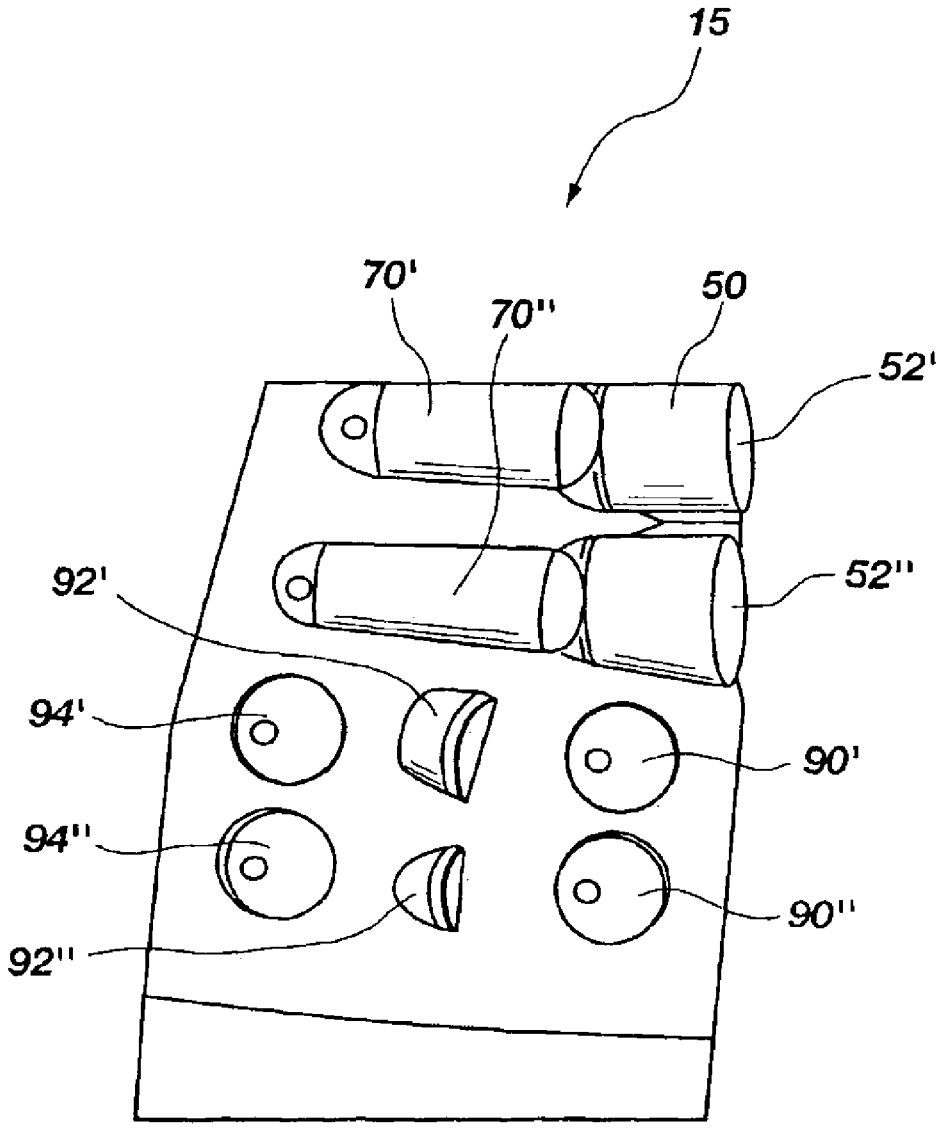
FIG. 3A is side view of a blade section having leading and trailing superabrasive structures as shown in FIGS. 1 and 2.

Turning to FIG. 3A, a truncated blade section 15 is shown having leading edge protective structures 90' and 90" associated with gage trimmers 92' and 92", respectively. Similarly, trailing edge protective structures 94' and 94" may be also associated with gage trimmers 92' and 92", respectively. Although gage trimmers are depicted in FIG. 3A as being substantially captured by the body of the bit, FIG. 3A is merely illustrative of the exposure of gage trimmers 92' and 92" with respect to the surface of the bit. Protective structures 90' and 90" may be exposed at substantially the same exposure as gage trimmers 92' and 92", respectively. Conventionally, gage trimmers may be brazed into corresponding cutter pockets (not shown) as known in the art. Cutters 50 are also shown having associated cutting faces 52' and 52" and wear knots 70' and 70", respectively.

Figure 3B:
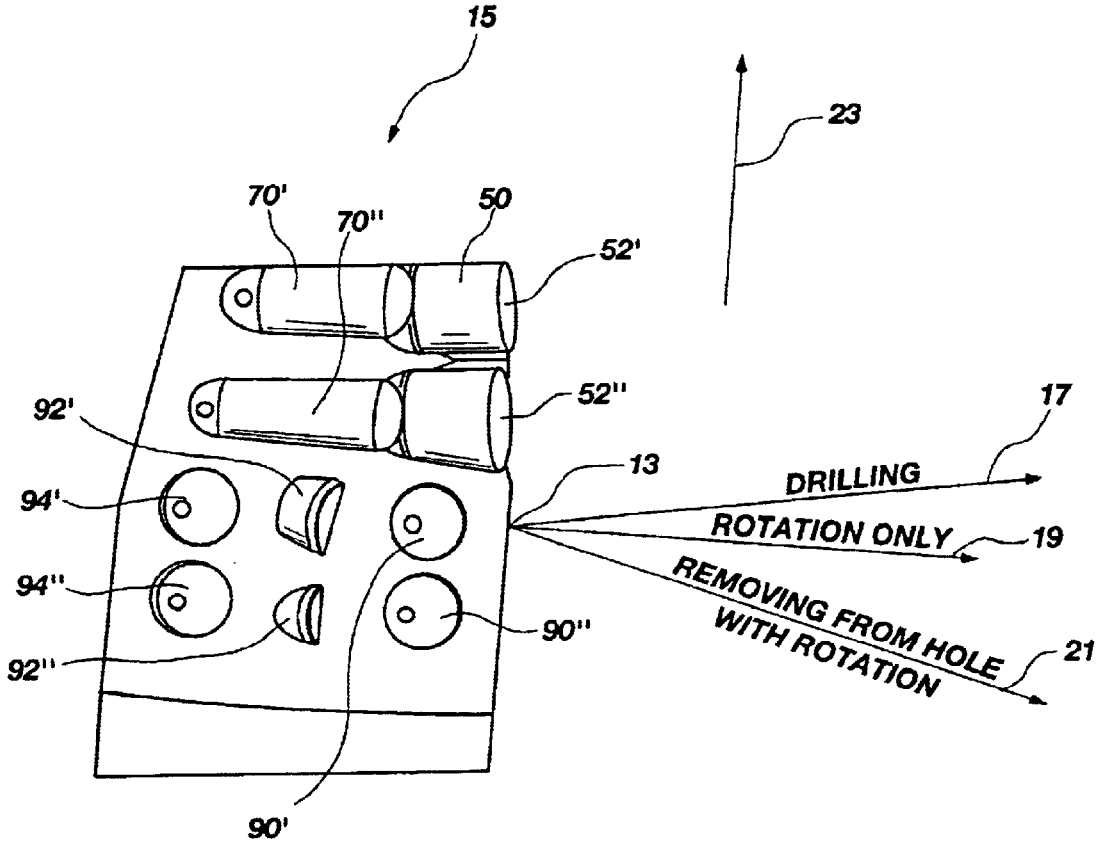
FIG. 3B is a side view of the blade section of FIG. 3A, illustrating the path of a point on the drill bit under different operating conditions.

FIG. 3B shows the path of a point on a rotary drill bit in terms of translating the rotation of the rotary drill bit into horizontal distance and plotting vertical displacement on the vertical axis. Stated another way, the rotation of the rotary drill bit is shown as a horizontal distance, and the vertical displacement of the rotary drill bit is shown as a vertical distance. In this way, the angle along which the cutters travel may be viewed graphically, and is simply a function of the rotational speed of the cutter as well as the vertical speed of the cutter. Horizontal path 19 illustrates the direction that point 13 may travel if the gage section were rotating but not moving vertically. Likewise, points on the bit may be displaced along congruent parallel paths with respect to horizontal path 19. Under conditions where the blade section 15 rotates and vertically advances into the formation (vertically advancing into the formation meaning in the direction of reference arrow 23), point 13 may follow path 17. Path 17 may vary according to rotational speed and vertical velocity. When blade section 15 is rotating very quickly and moving very slowly, vertically advancing into the formation, path 17 will be very close to path 19. If, however, blade section 15 is rotating slowly and moving vertically quickly, path 17 may be rotated about point 13 toward the formation. In contrast, path 21 shows rotation of blade section 15 as well as vertical displacement away from the formation, such as when the rotary drill bit is removed from the hole during rotation to back ream the hole.

Paths 17, 19, and 21 illustrate the angle that the cutters will move along under different drilling conditions. Accordingly, it may be advantageous to tailor protective structures in relation to predicted motion of the gage trimmers experienced during operation of the rotary drill bit. Protective structures may be substantially aligned to a horizontal path as shown by path 19 if impact loading is expected when the bit is not moving vertically, but simply rotating within the borehole or casing, as commonly occurs when drilling fluids are changed during drilling operations. Likewise, if impact loading is anticipated during drilling conditions (drilling or tripping), the protective structures may be positioned substantially in relation to a predicted motion to better shield the gage trimmer. Of course, protective structures may be designed and positioned in accordance with any anticipated motion, or a range of motions. Extrapolating the protective structure to protect from any cutter motion yields a protective structure that surrounds the gage trimmer.

Figure 4B:
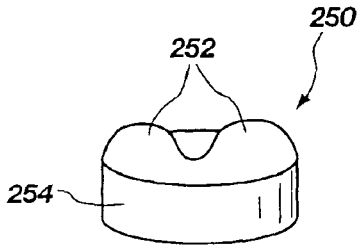
FIGS. 4A–4C are perspective views of several different protective structure embodiments of the present invention.
Figure 4A:
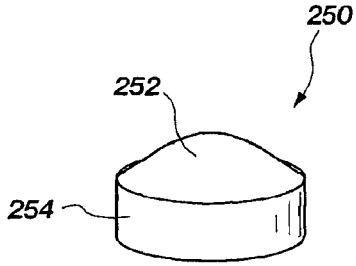

FIG. 4A illustrates an embodiment of a protective structure 250 of the present invention where the top surface 252 is generally ovoidal, but may be hemispherical or otherwise arcuate in shape. Longitudinal section 254 may be generally installed into a pocket on the bit body, either by a press fit or by way of brazing. Similarly, FIG. 4B illustrates another embodiment for a protective structure 250 wherein the top surface 252 forms two separate ovoidal, hemispherical, or otherwise arcuate protrusions. Such an embodiment may be useful in protecting two gage trimmers where the gage trimmer and protrusion placement are appropriate. Moving to FIG. 4C, protective structure 250 includes top surface 252, having a generally arcuate form with a relatively low curvature. However, top surface 252 may be tailored according to the shape of the formation that it engages. For instance, top surface 252 may be shaped so that at least a portion thereof conforms to the gage diameter. In addition, recesses 253 and 255 may be configured, positioned, and sized to provide a selected area of cut for a gage trimmer, so that a gage trimmer may be exposed to a selected area of the formation that is substantially unaffected by a protective structure.

Figure 4C:
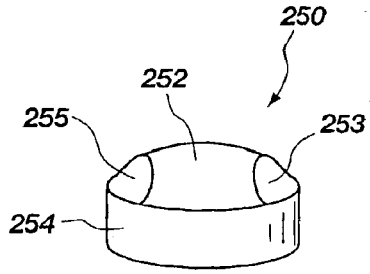
Figure 5A:
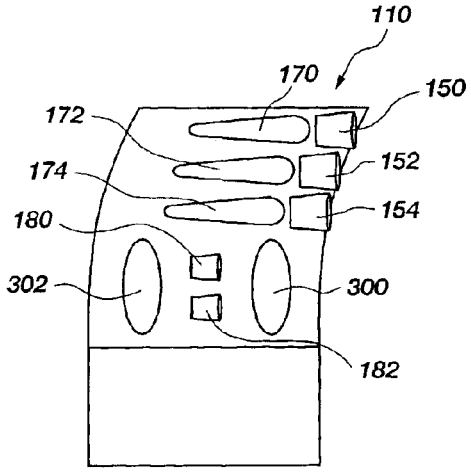
FIG. 5A is a side view of a blade section of the present invention having a single leading protective structure and single trailing protective structure proximate to multiple gage trimmers.

FIG. 5A shows a blade section 110 of the present invention configured with cutters 150, 152, and 154 as well as associated wear knots 170, 172, and 174, respectively. Blade section 110 may be configured wherein protective structure 300 is proximate to the leading edges of both gage trimmer 180 and gage trimmer 182. Similarly, protective structure 302 may be proximate to the trailing edges of both gage trimmers 180 and 182. Protective structure 300 is shown as having an elliptical cross section, but may comprise any number of geometries. In addition, the top surface of the protective structure may comprise various topographies as well. For instance, the top surface of protective structure 300 may be contoured in any number of ways as shown in FIGS. 4A–4C. In any event, the top surface of a protective structure that may be proximate to a gage trimmer may be substantially exposed equally to its associated gage trimmer. However, as shown in FIGS. 4A–4C, the top surface of a protective structure may vary and thereby accommodate differing gage trimmer exposures that may be proximate in different areas along the protective structure. Further, the protective structure or structures may be ground to substantially the same exposure as a proximate gage trimmer.

Figure 5B:
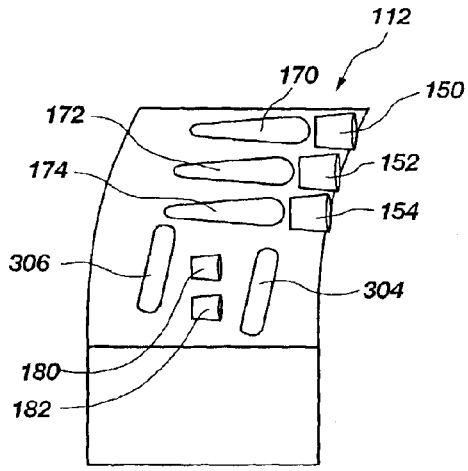
FIG. 5B is a side view of a blade section of the present invention having a single leading protective structure and single trailing protective structure proximate to multiple gage trimmers.

FIG. 5B shows blade section 112, wherein protective structure 304 is proximate to the leading edges of both gage trimmers 180 and 182. Also, protective structure 306 is proximate to the trailing edges of both gage trimmers 180 and 182. Additionally, protective structures 304 and 306 may be generally rectangular in shape and may be positioned at an angle with respect to the longitudinal axis of the drill bit (not shown). The position of protective structures may be tailored to provide preferential protection from an anticipated source of impact or from an anticipated direction of impact, as discussed above and shown in FIG. 3B. Protective structures 304 and 306 may be generally aligned to an angle that may be produced by removing the rotary drill bit from the hole while rotating the rotary drill bit, as illustrated by path 21 in FIG. 3B.

Figure 6A:
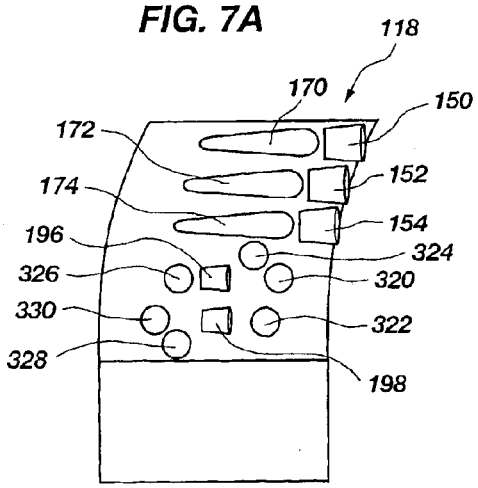
FIG. 6A is a side view of a blade section of the present invention having one arrangement of leading and trailing protective structures proximate to a gage trimmer that is tailored to a range of operating parameters.

FIG. 6A shows blade section 118 of the present invention configured with gage trimmers 196 and 198 as well as protective structures 320, 322, 324, 326, 328, and 330.

Depending on the helical angle that the gage trimmer follows, protective structure 320 may function as a protective structure proximate to the leading edge of either gage trimmer 196 or gage trimmer 198. Similarly, protective structure 330 may function as a protective structure proximate to the trailing edge of either gage trimmer 196 or gage trimmer 198. Protective structures 320, 322, and 324 are shifted vertically toward cutter 154, while protective structures 326, 328, and 330 are shifted vertically away from cutter 154. Such a configuration may provide protection from anticipated impact loading during drilling conditions. Specifically, protective structures 320, 322, and 324 may serve as leading edge protective structures for helical paths experienced during active drilling, while protective structures 326, 328, and 330 may serve as trailing protective structures. During rotation only, protective structures 320 and 326 serve as leading and trailing protective structures to gage trimmer 196, respectively. Correspondingly, protective structures 322 and 330 serve as leading and trailing protective structures to gage trimmer 198, respectively. Thus, FIG. 6A illustrates a protective structure configuration wherein multiple leading and trailing edge protective structures may serve differing gage trimmers under various operating conditions.

Figure 6B:
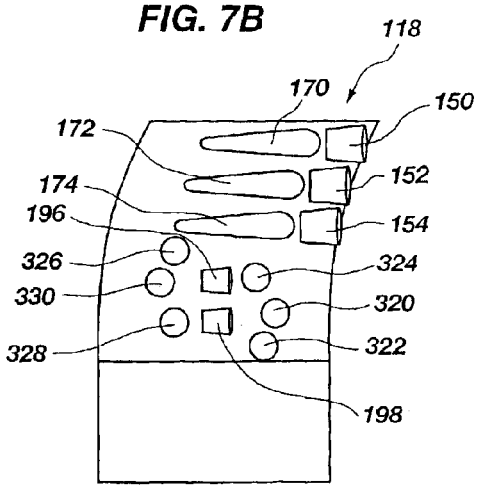
FIG. 6B is a side view of a blade section of the present invention having one arrangement of leading and trailing protective structures proximate to a gage trimmer that is tailored to a range of operating parameters.

Moving to FIG. 6B, blade section 118 of the present invention is configured with gage trimmers 196 and 198 as well as protective structures 320, 322, 324, 326, 328, and 330. Protective structures 320, 322, and 324 are shifted vertically away from cutter 154, while protective structures 326, 328, and 330 are shifted vertically toward cutter 154. Such a configuration may provide protection from anticipated impact loading during tripping conditions. Specifically, protective structures 320, 322, and 324 may serve as leading edge protective structures for helical paths experienced during active drilling, while protective structures 326, 328, and 330 may serve as trailing protective structures. During rotation without longitudinal displacement of the rotary drill bit, protective structures 324 and 330 serve as leading and trailing protective structures to gage trimmer 196, respectively. Correspondingly, protective structures 320 and 328 serve as leading and trailing protective structures to gage trimmer 198, respectively.

Figure 7A:
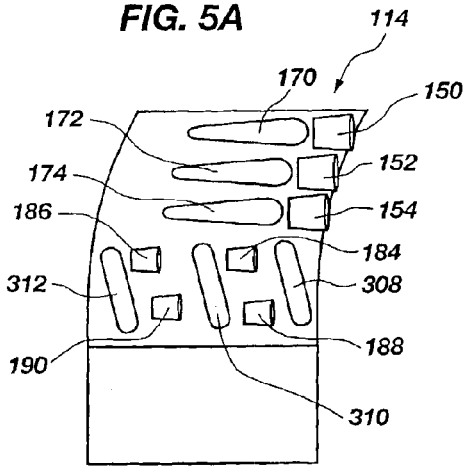
FIG. 7A is a side view of a blade section of the present invention having leading and trailing protective structures wherein at least one protective structure is positioned as both a leading protective structure to a gage trimmer and a trailing protective structure to another gage trimmer.

FIG. 7A illustrates a blade section 114 having multiple gage trimmers 184, 186, 188, and 190 arranged in generally longitudinal columns delineated by protective structures 308, 310, and 312. Protective structure 308 is positioned proximate to the leading edges of gage trimmers 184 and 188, while protective structure 312 is proximate to the trailing edges of gage trimmers 186 and 190. In this embodiment, protective structure 310 is proximate to the trailing edges of gage trimmers 184 and 188 and also proximate to the leading edges of gage trimmers 186 and 190. Thus, gage trimmers in this design are not substantially centered on blade section 114 in this embodiment. Generally, gage trimmers may be configured in any manner that the available space allows, and may be staggered or otherwise positioned.

Figure 7B:
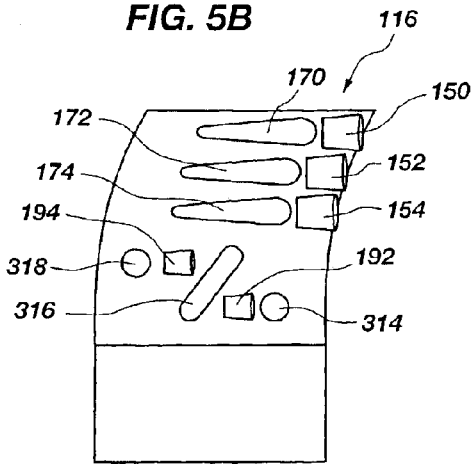
FIG. 7B is a side view of a blade section of the present invention having staggered gage trimmers with leading and trailing protective structures wherein at least one protective structure is proximate to a side of a gage trimmer and wherein at least one protective structure is positioned as both a leading protective structure to a gage trimmer and a trailing protective structure to another gage trimmer.

FIG. 7B shows a blade section 116 configured with a protective structure of the present invention wherein protective structure 316 serves as a protective structure proximate to the leading edge of gage trimmer 194 as well as a trailing protective structure proximate to the trailing edge of gage trimmer 192. Protective structure 314 is proximate to the leading edge of gage trimmer 192 and protective structure 318 is proximate to the trailing edge of gage trimmer 194. In addition, protective structure 316 provides protection to the side of gage trimmer 192 toward cutter 154 as well as the side of gage trimmer 194 away from cutter 154. Thus, in this configuration, gage trimmers 192 and 194 are protected by protective structures on substantially three sides. Other configurations contemplated by the present invention include toroidally shaped sections positioned about a gage trimmer, or S-shaped protective structures that weave around one or more gage trimmers. Many alternative designs to protect gage trimmers in multiple directions are possible.

Figure 8:
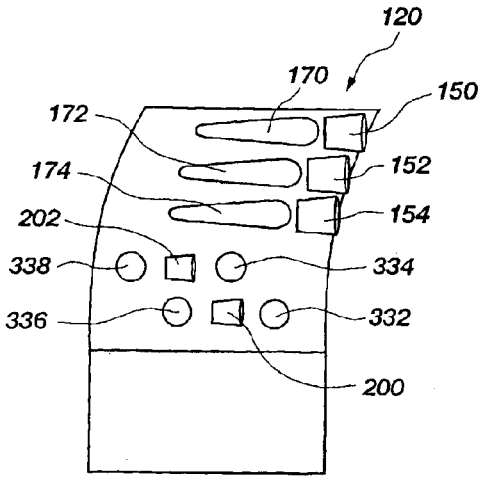
FIG. 8 is a side view of a blade section of the present invention having staggered gage trimmers with leading and trailing protective structures wherein at least one protective structure is proximate to a side of a gage trimmer.

For instance, FIG. 8 shows an embodiment of blade section 120 wherein protective structures shield the gage trimmer(s) from more than two directions. Protective structures 332, 334, 336, and 338 may be positioned so that gage trimmers 200 and 202 may be protected on substantially three sides. Considering gage trimmer 200, protective structure 332 is proximate to the leading edge, protective structure 336 is proximate to the trailing edge, and protective structure 334 is proximate to the side of gage trimmer 200. Similarly, viewing gage trimmer 202, protective structure 334 is proximate to the leading edge, protective structure 338 is proximate to the trailing edge, and protective structure 336 is proximate to the side of gage trimmer 202.

Figure 9:
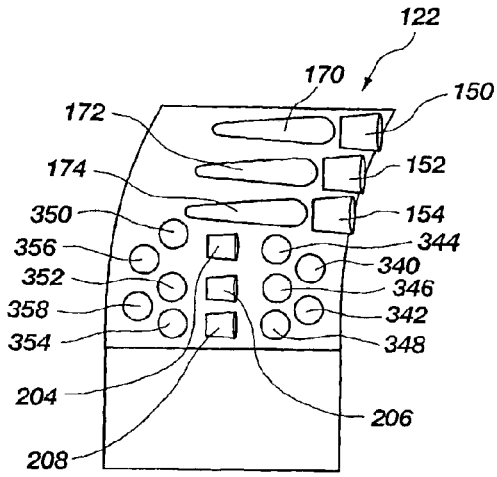
FIG. 9 is a side view of a blade section of the present invention having multiple leading protective structures and multiple trailing protective structures in a group of gage trimmers.

Turning to FIG. 9, blade section 122 is shown with a multiple protective structure embodiment comprising ten protective structures positioned proximate to three gage trimmers 204, 206, and 208. Protective structures 344, 340, 346, 342, and 348 may serve as leading edge gage trimmer protectors, while protective structures 350, 356, 352, 358, and 354 may serve as trailing edge gage trimmer protectors. It may be advantageous to stagger multiple protective structures proximate to the leading edge of multiple gage trimmers in that redundancy and overlapping protection regions may provide enhanced protection for the gage trimmers. Staggered columns of protective structures may be desirable if sufficient space is available on the blade.

Figure 10:
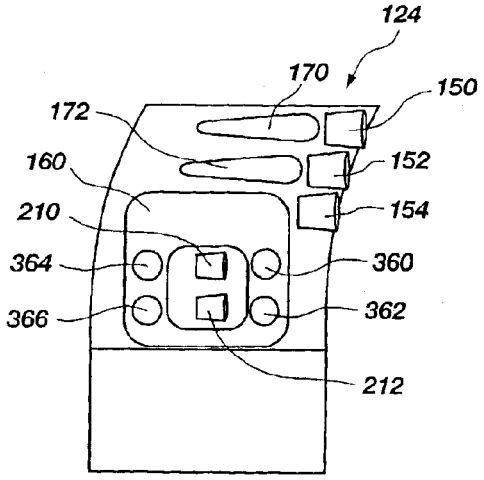
FIG. 10 is a side view of a blade section of the present invention having a protective structure comprising bit body material and having imbedded sintered tungsten carbide material that substantially surrounds two gage trimmers.

As a further embodiment, FIG. 10 shows a blade section 124 wherein protective structures 360, 362, 364, and 366 are positioned at least partially within bit body element 160. Bit body element 160 is similar to wear knots 70, as shown in FIG. 1, or wear knots 170 and 172, as shown in FIGS. 5A–10. However, in addition to providing a wear knot associated with cutter 154, bit body element 160 also at least partially supports protective structures 360, 362, 364, and 366. Bit body element 160 may substantially be exposed equally to protective structures 360, 362, 364, and 366; thus, the bit body element 160 may be flush with the protective structures 360, 362, 364, and 366. Alternatively, bit body element 160 may provide support to protective structures 360, 362, 364, and 366 at less exposure than the gage trimmers 210 and 212. Since a portion of the bit body element 160 may function as a wear knot associated with cutter 154, and may be proximate to the leading and trailing edges of gage trimmers 210 and 212, the topography of bit body element 160 may vary to accommodate the potentially differing desired exposures over the area of bit body element 160. Further, bit body element 160 may be also proximate to the side of gage trimmer 210 nearest cutter 154 as well as proximate to the side of gage trimmer 212 farthest from cutter 154, and therefore may be used to further protect the gage trimmers 210 and 212 on their respective sides. Multiple bit body elements may be employed and may be formed as small support structures for each protective structure, or for particular support structures. In addition, bit body elements may be freestanding, similar to wear knots 170 and 172.

Figure 11A:
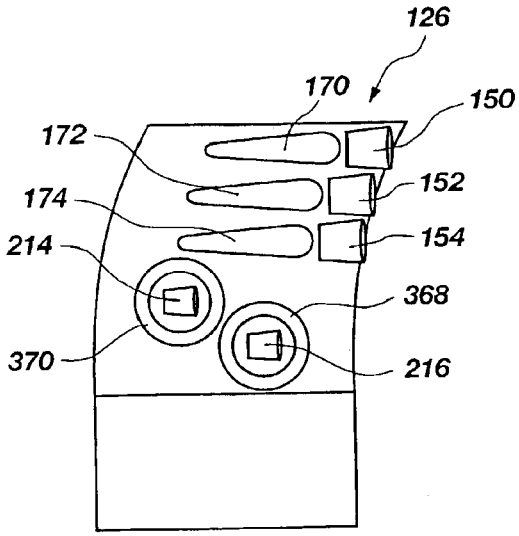
FIGS. 11A and 11B are side views of a blade section of the present invention having protective structures that completely surround their associated gage trimmers circularly and ovally, respectively.
Figure 11B:
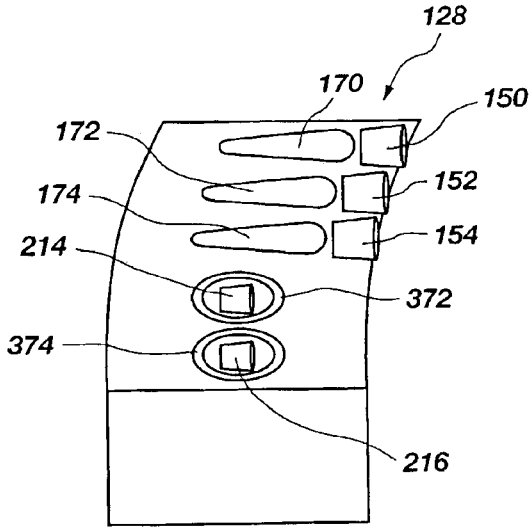

As mentioned hereinabove, a protective structure that protects from any helical path may be a desirable configuration for protection of a gage trimmer. FIGS. 11A and 11B show two embodiments of protective structures that surround gage trimmers. More specifically, referring to FIG. 11A, blade section 126 includes gage trimmer 214 which is surrounded by a hollow cylindrical protective structure 370 while gage trimmer 216 is surrounded by a hollow cylindrical protective structure 368. Clearly, each protective structure 368 and 370 may be proximate to the leading and trailing edges of its respective gage trimmers, 216 and 214. Similarly, in FIG. 11B, blade section 128 includes hollow elliptical protective structures 372 and 374 surrounding gage trimmers 214 and 216, respectively. It should be noted, however, that the protective structures need not completely surround the gage trimmers. Other protective structure embodiments that substantially surround or partially surround the gage trimmer may be employed. Also, the protective structure may be comprised of disparate pins, columns, or otherwise separate elements if desirable.

Figure 12A:
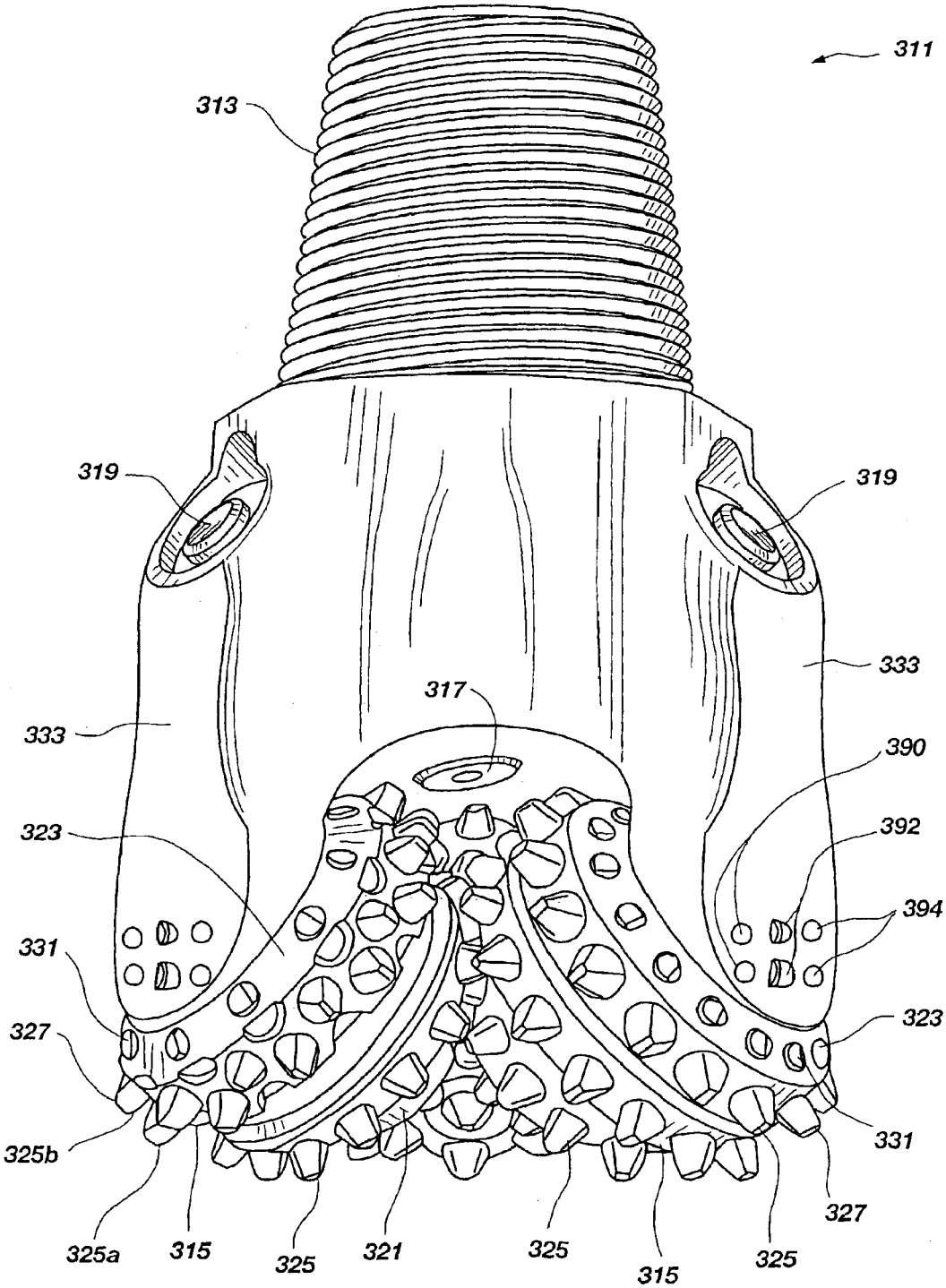
FIGS. 12A and 12B are perspective views of different embodiments of tricone drill bits with protective structures according to the present invention disposed thereon.

As an additional embodiment, the present invention may be installed upon a tricone drill bit as known in the art. Referring to FIG. 12A, an earth-boring bit 311 has a threaded pin section 313 on its upper end for securing the bit to a string of drill pipe. A plurality of earth-disintegrating cutters 315, usually three, are rotatably mounted on bearing shafts (not shown) carried by legs 333 depending from the bit body. At least one nozzle 317 is provided to discharge drilling fluid pumped from the drill string to the bottom of the borehole. A lubricant pressure compensator system 319 is provided for each cutter to reduce a pressure differential between the borehole fluid and the lubricant in the bearings of the cutters 315.

Each cutter 315 is generally conical and has nose area 321 at the apex of the cone, and a gage surface 323 at the base of the cone. The gage surface 323 is frusto-conical and is adapted to contact the sidewall of the borehole as the cutter 315 rotates about the borehole bottom. Each cutter 315 has a plurality of wear-resistant inserts 325 secured by interference fit into mating sockets drilled in the supporting surface of the cutter 315. These wear-resistant inserts 325 may be constructed of a hard, fracture-tough material such as cemented tungsten carbide. Inserts 325 generally are located in rows extending circumferentially about the generally conical surface of the cutters 315. Certain of the rows are arranged to intermesh with other rows on other cutters 315. One or two of the cutters may have staggered rows consisting of a first row 325*a* of inserts and a second row 325*b* of inserts. A first or heel row 327 is a circumferential row that is closest to the edge of the gage surface 323. A row of gage trimmers 331 may be secured to the gage surface 323 of the cutter 315 as disclosed by U.S. Pat. No. 5,467,836, assigned to the assignee of the present invention and incorporated herein in its entirety by reference thereto.

Further, leading protective structures 390 proximate to the rotationally leading edges of gage trimmers 392 and trailing protective structures 394 proximate the rotationally trailing edges of gage trimmers 392 may be carried by legs 333. Gage trimmers 392 may provide increased gage holding capability in addition to the rows of gage trimmers 331. Thus, protective structures may be configured to protect gage trimmers carried by bit bodies of many types.

Figure 12B:
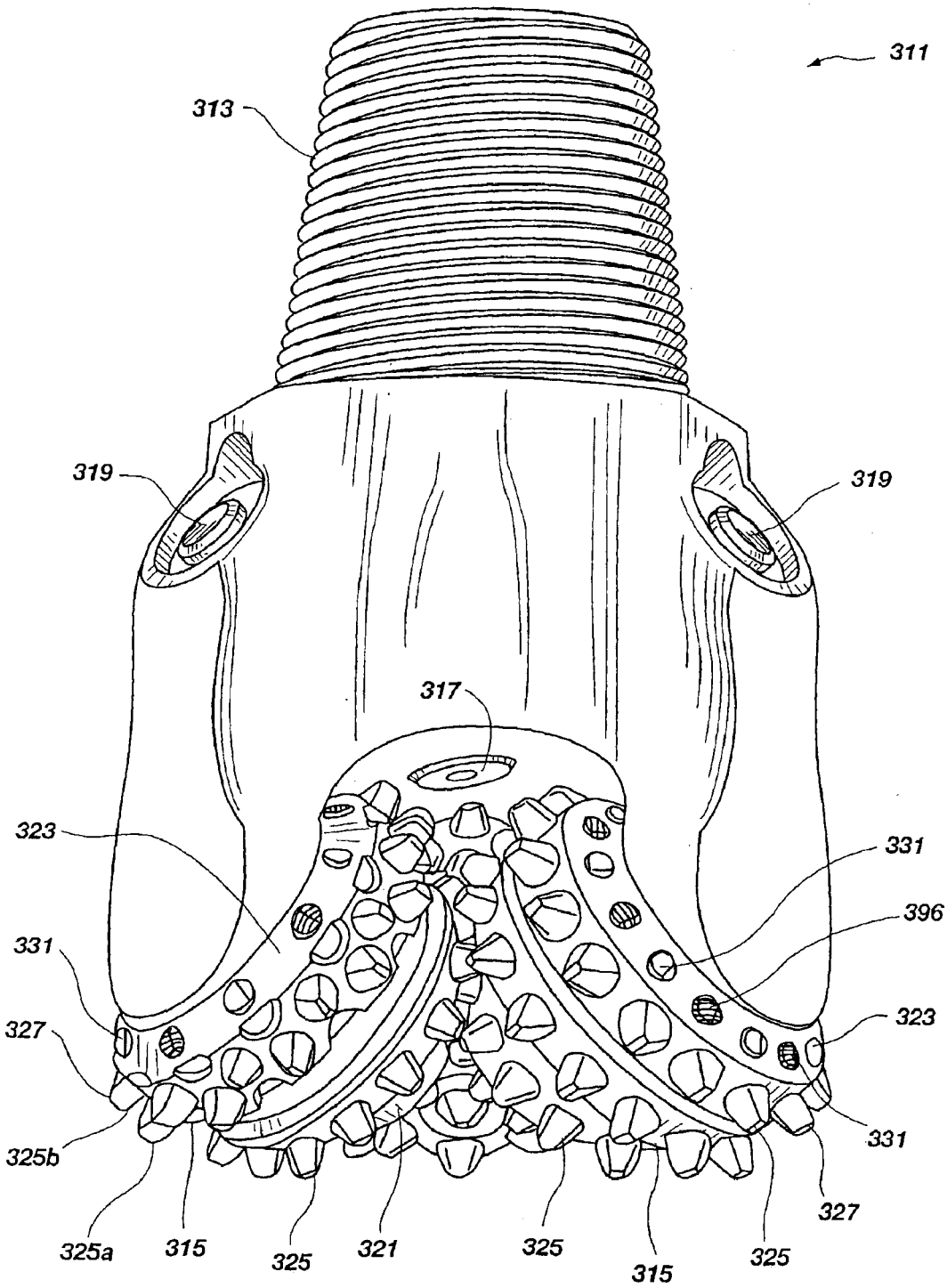

Alternatively, as shown in FIG. 12B, protective structures 396 may be installed on the gage surface 323, interspersed between gage trimmers 331. Such a configuration may prevent or limit gage surface 323 from contacting a borehole or casing. In addition, such a configuration may allow for an increased number of protective structures 396 to be carried by a bit body, since the gage surface 323 may provide an increased area for placing protective structures 396. As protective structures 396 may be interspersed between gage trimmers 331, one protective structure 396 may be proximate to the rotationally leading edge of one gage trimmer 331 while being proximate the rotationally trailing edge of another gage trimmer 331. Of course, other embodiments are contemplated by the present invention, one being a repeating pattern of one gage trimmer 331 separated by two protective structures 396 from another gage trimmer 331.

Although the foregoing description contains many specifics, these should not be construed as limiting the scope of the present invention, but merely as providing illustrations of some exemplary embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced thereby.

What is claimed is:

1. A rotary apparatus for drilling a borehole within a subterranean formation, comprising:

a bit body having a longitudinal axis and a connection structure for connecting the rotary apparatus to a drill string;

a plurality of cutting structures carried by the bit body;

at least one gage trimmer affixed to the bit body, the at least one gage trimmer sized and positioned for cutting an outer diameter of the borehole; and at least one protective structure affixed to the bit body proximate to a rotationally leading edge and a rotationally trailing edge of the at least one gage trimmer;

wherein the at least one protective structure is sized and positioned to inhibit damaging contact with the at least one gage trimmer and has a wear resistance which is less than a wear resistance of the at least one gage trimmer.

2. The rotary apparatus of claim 1, wherein the plurality of cutting structures comprises a plurality of superabrasive cutters.

3. The rotary apparatus of claim 1, wherein the at least one protective structure comprises sintered tungsten carbide.

4. The rotary apparatus of claim 1, wherein the at least one gage trimmer comprises a plurality of gage trimmers.

5. The rotary apparatus of claim 4, wherein at least one protective structure is proximate to the rotationally leading edge of one gage trimmer of the plurality and proximate to the rotationally trailing edge of another gage trimmer of the plurality.

6. The rotary apparatus of claim 4, wherein one protective structure is proximate to the rotationally leading edge of more than one gage trimmer of the plurality.

7. The rotary apparatus of claim 4, wherein one protective structure is proximate to the rotationally trailing edges of more than one gage trimmer of the plurality.

8. The rotary apparatus of claim 4, wherein one protective structure is proximate to the rotationally leading edges of more than one gage trimmer of the plurality and proximate to the rotationally trailing edges of more than one gage trimmer of the plurality.

9. The rotary apparatus of claim 1, wherein the at least one protective structure comprises a plurality of protective structures.

10. The rotary apparatus of claim 9, wherein one protective structure of the plurality is proximate to the rotationally leading edge of a first gage trimmer of the at least one gage trimmer and another protective structure of the plurality is proximate to the rotationally trailing edge of the first gage trimmer.

11. The rotary apparatus of claim 9, wherein more than one protective structure of the plurality is proximate to the rotationally leading edge of a gage trimmer of the at least one gage trimmer.

12. The rotary apparatus of claim 9, wherein more than one protective structure of the plurality is proximate to the rotationally trailing edge of a gage trimmer of the at least one gage trimmer.

13. The rotary apparatus of claim 9, wherein more than one protective structure of the plurality is proximate to both the rotationally trailing edge and rotationally leading edge of a gage trimmer of the at least one gage trimmer.

14. The rotary apparatus of claim 1, further comprising at least another protective structure proximate to a periphery of the at least one gage trimmer.

15. The rotary apparatus of claim 1, wherein a gage trimmer of the at least one gage trimmer is substantially surrounded by the at least one protective structure.

16. The rotary apparatus of claim 1, wherein the at least one protective structure is positioned according to a predicted helix angle.

17. The rotary apparatus of claim 1, wherein the at least one protective structure is positioned according to an anticipated gage trimmer motion.

18. The rotary apparatus of claim 1, wherein an exposure of a protective structure of the at least one protective structure proximate to a gage trimmer of the at least one gage trimmer is substantially equal to the exposure of the gage trimmer of the at least one gage trimmer.

19. The rotary apparatus of claim 1, wherein the at least one protective structure has an upper surface topography of at least one of a domed shape and an ovoidal shape.

20. The rotary apparatus of claim 1, wherein the at least one gage trimmer comprises at least one superabrasive cutter.

21. The rotary apparatus of claim 1, wherein:

the drilling apparatus comprises a roller cone drill bit; and the at least one gage trimmer is mounted upon a leg of the roller cone drill bit.

22. A method of drilling a borehole in a subterranean formation, comprising:

disposing a drilling apparatus carrying a plurality of cutting structures within a borehole;

wherein the drilling apparatus includes at least one gage trimmer sized and positioned for cutting an outer diameter of the borehole;

wherein the drilling apparatus includes at least one protective structure sized, positioned, and configured to inhibit damaging contact with the at least one gage trimmer and has a wear resistance which is less than a wear resistance of the at least one gage trimmer; and rotating the drilling apparatus to drill out the subterranean formation to at least a drill diameter.

23. The method of claim 22, wherein the rotating causes the at least one gage trimmer and associated at least one protective structure to have substantially equal exposures.

24. A method of operating a drilling system within a borehole comprising:

disposing a drilling apparatus carrying a plurality of cutting structures within a casing;

wherein the drilling apparatus includes at least one gage trimmer sized and positioned for cutting an outer diameter of the borehole;

wherein the drilling apparatus includes at least one protective structure sized, positioned, and configured to inhibit damaging contact with the at least one gage trimmer and has a wear resistance which is less than a wear resistance of the at least one gage trimmer;

disposing a drilling fluid within the casing;

rotating the drilling apparatus within the casing; and changing the drilling fluid within the drilling system.

25. The method of claim 24, wherein disposing a drilling fluid comprises disposing a water-based drilling fluid.

26. The method of claim 25, wherein changing the drilling fluid comprises introducing an additive to the drilling fluid.

27. The method of claim 25, wherein changing the drilling fluid comprises substantially removing the water-based drilling fluid and introducing an oil-based drilling fluid.

28. The method of claim 24, wherein disposing a drilling fluid comprises disposing an oil-based drilling fluid.

29. The method of claim 28, wherein changing the drilling fluid comprises introducing an additive to the drilling fluid.

30. The method o claim 28, wherein changing the drilling fluid comprises substantially removing the oil-based drilling fluid and introducing a water-based drilling fluid.

31. The method of claim 24, wherein changing the drilling fluid comprises modifying a drilling fluid characteristic selected from the group consisting of mud weight, pH, chemical composition, physical composition, and viscosity.

32. The method of claim 24, wherein changing the drilling fluid comprises introducing an additive to the drilling fluid.

33. A method of designing a rotary apparatus for drilling a borehole in a subterranean formation, the rotary apparatus under design including a plurality of cutting structures, the method comprising:

selecting at least one gage trimmer configured for cutting an outer diameter of the borehole;

selecting at least one protective structure configured for inhibiting damage to the at least one gage trimmer;

wherein the at least one protective structure has a wear resistance which is less than a wear resistance of the at least one gage trimmer; and positioning the at least one gage trimmer proximate to rotationally leading and trailing edges of the at least one gage trimmer.

34. The method of claim 33, wherein selecting at least one protective structure comprises selecting at least one sintered tungsten carbide protective structure.

35. The method of claim 33, further comprising predicting a helix angle from anticipated operating parameters for the rotary apparatus.

36. The method of claim 35, further comprising positioning the at least one protective structure according to the predicted helix angle.

37. The method of claim 33, further comprising predicting a gage trimmer motion from anticipated operating parameters for the rotary apparatus.

38. A The method of claim 37, further comprising positioning the at least one protective structure according to the predicted gage trimmer motion.

39. The method of claim 33, wherein selecting at least one gage trimmer comprises selecting a plurality of gage trimmers.

40. The method of claim 39, wherein positioning the at least one gage trimmer comprises positioning the at least one protective structure proximate to the rotationally leading edge of one gage trimmer of the plurality and proximate to the rotationally trailing edge of another gage trimmer of the plurality.

41. The method of claim 39, wherein positioning the at least one gage trimmer comprises positioning the at least one protective structure proximate to rotationally leading edges of more than one gage trimmer of the plurality.

42. The method of claim 39, wherein positioning the at least one gage trimmer and protective structure arrangement comprises positioning the at least one protective structure proximate to rotationally trailing edges of more than one gage trimmer of the plurality.

43. The method of claim 39, wherein positioning the at least one gage trimmer comprises positioning the at least one protective structure proximate to rotationally leading edges of more than one gage trimmer of the plurality and proximate to rotationally trailing edges of more than one gage trimmer of the plurality.

44. The method of claim 33, wherein selecting at least one protective structure comprises selecting a plurality of protective structures.

45. The method of claim 44, wherein positioning the at least one gage trimmer comprises positioning more than one protective structure of the plurality proximate to the rotationally leading edge of a gage trimmer of the at least one gage trimmer.

46. The method of claim 44, wherein positioning the at least one sage trimmer comprises positioning more than one protective structure of the plurality proximate to the rotationally trailing edge of a gage trimmer of the at least one gage trimmer.

47. The method of claim 33, wherein:

selecting the at least one protective structure comprises selecting at least two protective structures; and positioning the at least two protective structures proximate to a periphery of the at least one gage trimmer.

48. The method of claim 33, further comprising substantially equalizing an exposure of the at least one gage trimmer with a proximate at least one protective structure.

49. The method of claim 33, wherein selecting at least one protective structure comprises selecting at least one protective structure having an upper surface topography of at least one of a domed shape and an ovoidal shape.

50. The method of claim 33, wherein selecting at least one gage trimmer comprises selecting at least one superabrasive cutter.

51. The method of claim 33, further comprising:

wherein the rotary apparatus under design comprises a roller cone drill bit; and positioning the at least one gage trimmer upon a leg of the roller cone drill bit.

* * * * *

UNITED STATES PATENT AND TRADEMARK OFFICE

CERTIFICATE OF CORRECTION

PATENT NO. : 6,883,623 B2
APPLICATION NO. : 10/268595
DATED : April 26, 2005
INVENTOR(S) : Ronny D. McCormick et al.

It is certified that error appears in the above-identified patent and that said Letters Patent is hereby corrected as shown below:

| | | | |
|---|---|---|---|
| | COLUMN 5, | LINE 6, | change "FIG. 3A is side view" to --FIG. 3A is a side view-- |
| CLAIM 30, | COLUMN 14, | LINE 23, | change "method o" to --method of-- |

Signed and Sealed this

Fourteenth Day of April, 2009

JOHN DOLL
*Acting Director of the United States Patent and Trademark Office*